US007179237B2

(12) United States Patent
Elan

(10) Patent No.: US 7,179,237 B2
(45) **Date of Patent: *Feb. 20, 2007**

(54) DEVICE FOR PREVENTING OR RELIEVING PAIN IN THE LOWER BACK

(75) Inventor: Ori Elan, Tel Aviv (IL)

(73) Assignee: Backlife Ltd., Or Yehuda (IL)

( * ) Notice: Subject to any disclaimer, the term of this patent is extended or adjusted under 35 U.S.C. 154(b) by 590 days.

This patent is subject to a terminal disclaimer.

(21) Appl. No.: 10/363,759

(22) PCT Filed: Dec. 14, 2000

(86) PCT No.: PCT/IL00/00836

§ 371 (c)(1),
(2), (4) Date: Dec. 27, 2002

(87) PCT Pub. No.: WO01/51000

PCT Pub. Date: Jul. 19, 2001

(65) Prior Publication Data

US 2003/0204911 A1 Nov. 6, 2003

(51) Int. Cl.
*A61H 1/02* (2006.01)

(52) U.S. Cl. ..... 601/35; 606/241; 601/5

(58) Field of Classification Search ..... 606/237, 606/240–242; 601/5, 33–35, 85–87, 89, 601/90, 93

See application file for complete search history.

(56) References Cited

U.S. PATENT DOCUMENTS 2,290,407 A 7/1942 Collins
2,874,689 A 2/1959 Gavelek
2,893,380 A * 7/1959 Walker et al. ..... 601/24
3,661,149 A * 5/1972 Ferries ..... 601/35
4,278,249 A 7/1981 Forrest
4,492,222 A 1/1985 Hajianpour
4,537,393 A 8/1985 Kusch
4,558,692 A 12/1985 Greiner
4,566,440 A 1/1986 Berner et al.
4,621,620 A * 11/1986 Anderson ..... 601/34
4,637,379 A 1/1987 Saringer
4,949,712 A 8/1990 Torii
5,085,425 A 2/1992 Collins et al.
5,137,015 A 8/1992 Anglehart
5,336,138 A 8/1994 Arjawat
5,399,147 A 3/1995 Kaiser
5,421,798 A * 6/1995 Bond et al. ..... 601/23
5,460,596 A * 10/1995 Brady ..... 601/35
5,468,215 A 11/1995 Park
5,569,175 A 10/1996 Chitwood
5,601,519 A 2/1997 Comereski
5,772,612 A 6/1998 Ilan (Continued)

*Primary Examiner*—Danton DeMille
*Assistant Examiner*—Manuj Agarwal

(57) ABSTRACT

A device for preventing or relieving pain in the lower back of a human subject includes a body-engaging element configured for engaging a region of the subject's body inferior to the lumbar vertebrae while the subject lies in a supine position. A drive mechanism is configured to move the body-engaging element through a repetitive cyclic motion which includes an operative motion along a first path including a primarily vertical lifting motion followed by a primarily horizontal tensioning motion, and a return motion along a second path, the second path lying generally below the first path. The body-engaging element preferably includes at least one surface configured for engaging a rear surface of both of the subject's legs from the knees downwards.

26 Claims, 11 Drawing Sheets

U.S. PATENT DOCUMENTS 5,901,581 A 5/1999 Chen et al.
5,984,836 A 11/1999 Casali
6,030,352 A * 2/2000 Paik ..... 601/23
6,056,706 A * 5/2000 Hung ..... 601/89
6,106,491 A 8/2000 Gianutsos
6,443,916 B1 * 9/2002 Ilan ..... 601/26

* cited by examiner

DEVICE FOR PREVENTING OR RELIEVING PAIN IN THE LOWER BACK

RELATED PATENT APPLICATIONS

This application is a National Phase Entry of PCT/IL00/00836 filed 14 Dec. 2000, which claims priority from U.S. patent application Ser. No. 09/479,661 filed 10 Jan. 2000 now U.S. Pat No. 6,443,916.

FIELD AND BACKGROUND OF THE INVENTION

The present invention relates to a stretching device, particularly useful for the relieving or preventing of lower back pains.

It is well known that lower back pains affect a very large proportion of adults, especially middle aged adults and older. As a consequence, a great deal of suffering and disability is experienced by a large fraction of the population resulting, among other things, in a large number of lost work days and greatly diminished quality of life.

A brief physiological analysis will help illustrate the cause of back pains and give an insight as to possible remedies.

The spinal column consists of thirty three vertebrae which are joined together by cartilage tissue and ligaments. The upper twenty four vertebrae are discrete and movable while the lower nine vertebrae are fixed. Five of the lower nine vertebrae are fused together to form the sacrum while the terminal four vertebrae are normally fused to form the coccyx. The normal spinal column may be considered to have seven cervical, twelve thoracic, five lumbar, five sacral and four coccygeal vertebrae. Mobility of the vertebrae in the cervical, thoracic and lumbar regions is relatively free compared with movement of the fused vertebrae of the sacrum and coccyx which is relatively constrained.

The main causes of common back pain are the continual stresses and strains experience by the lower back region which is the major, albeit not the sole, weight supporting element of the upper body.

These stresses and strains eventually cause the damage symptomatic of back pain in that the cartilage material forming the discs separating the vertebrae is worn away over a period of time. In its extreme pathological condition, the patient may develop anchilosing spondylitis, namely, the partial, bent-down stiffening of the spinal column.

The sensation of pain is felt because the distance separating the vertebrae becomes narrower, causing pressure to be exerted on the nerve roots which extend from the spinal cord.

Due to the degenerative nature of the causes of back pain of this sort there is currently no permanent relief available, except for surgery where appropriate. There are, however, a multitude of known procedures for the relief of pain in the lumbar region of the back. These procedures involve the stretching of the lower back to achieve the separation of the discs in the affected lumbar area. However, these treatments typically require the use of weights and other mechanical equipment and must be undertaken only under close professional supervision.

U.S. Pat. No. 5,772,612 to Daniel Ilan, hereby incorporated by reference, proposes a device suitable for home use in which a user lies on an underlying surface with his or her knees over a frame and feet against a foot rest. The lower end of the device contacts the underlying surface, acting as a fulcrum. When the user pushes against the device, the device pivots so as to tend to lift the user's legs along a slightly arched path. A motor-driven version of the device is also proposed.

The device of the aforementioned patent represents a useful attempt to provide a device for relieving lower-back pain suitable for home use. It has been noted, however, that the resulting motion, namely, a slightly arched reciprocating motion, differs considerably from the sequence of motion performed by a trained physiotherapist. Specifically, with reference to FIGS. 1A–1C, a trained physiotherapist typically performs an initial lifting movement by raising the subject's legs from the position of FIG. 1A to that of FIG. 1B so as to neutralize the arched concavity of the back. This is followed by a primarily horizontal pulling motion (FIG. 1C), thereby applying tension tending to relieve pressure between the lumber vertebrae. The tension is then released, thereby allowing the body to return under the action of gravity to a resting position.

There is therefore a need for a device for preventing or relieving pain m the lower back of a human subject which would more closely emulate the aforementioned therapeutic movement used by trained physiotherapists.

SUMMARY OF THE INVENTION

The present invention relates to a device for preventing or relieving pain in the lower back of a human subject.

According to one aspect of the present invention, there is provided a device for preventing or relieving pain in the lower back of a human subject while the subject lies in a supine position on an underlying surface, the device comprising: (i) a body-engaging clement configured for engaging the rear surfaces of both knees of the subject; and (ii) a drive mechanism mechanically linked to said body-engaging element, said drive mechanism being configured to move said body-engaging element through a repetitive cyclic motion including (a) an operative motion along a first path operative to move both upper legs together in the outward direction substantially parallel to their longitudinal axes to apply tension to the lumbar vertebrae in the lower back of the subject, and (b) a return motion along a second path, said second path lying generally below said first path.

According to another aspect of the present invention, there is provided a device for preventing or relieving pain in the lower back of a human subject, the device being configured for use while the subject lies in a supine position on an underlying surface, the device comprising: (a) a body-engaging clement configured for engaging the rear surfaces of both knees of the subject; and (b) a rotary drive for driving said body engaging clement, said rotary drive including a pivot pin pivotally mounting the body engaging element and slidable within a slot during the rotation of said rotary drive such as to drive the body-engaging element, and both knees when engaged thereby, from an initial position through repetitive closed-loop cycles each including: (i) a forward stroke path having a vertical lifting component for lifting the engaged rear surfaces of both knees together such as to neutralize the natural arched concavity of the subject's back, and a horizontal pulling component for tensioning the engaged rear surfaces of both knees such as to relieve pressure in the subject's lumber vertebrae; and (ii) a return stroke path, different from and underlying the forward stroke path, for returning the engaged rear surfaces of both knees to their initial positions.

According to further features in the described preferred embodiment of the present invention, the first path includes a primarily vertical lifting motion followed by a primarily horizontal tensioning motion; and the second path includes a primarily vertical lowering motion followed by a primarily horizontal return motion.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
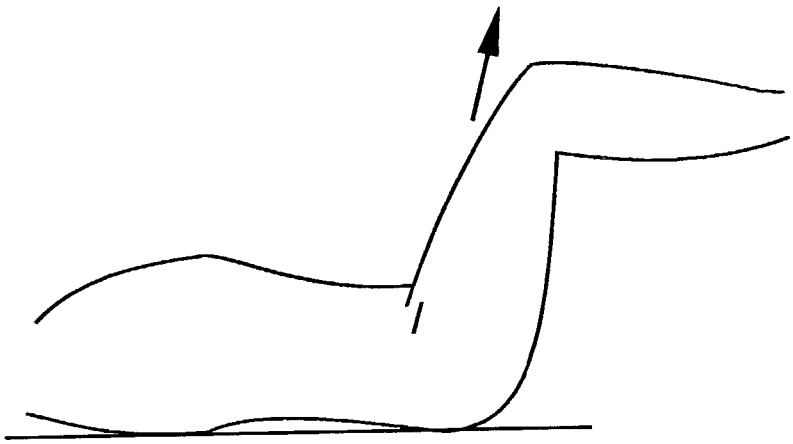
FIGS. 1*a*–1*c* are schematic representations of a sequence of movements occurring during manual physiotherapy for lower back pain and closely emulated by devices in accordance with the present invention.

The present invention is a device for preventing or relieving pain in the lower back of a human subject.

The principles and operation of devices according to the present invention may be better understood with reference to the drawings and the accompanying description.

Referring now to the drawings, FIGS. 2–8 show a device, generally designated 10, constructed and operative according to the teachings of the present invention. Device 10, configured for use while lying in a supine position, is helpful for preventing or relieving pain in the lower back of a human subject.

Generally speaking, device 10 provides at least one body-engaging element 12 configured for engaging at least one region of the body of the subject inferior to the subject's lumbar vertebrae, and a drive mechanism 14, mechanically linked to body-engaging element 12. It is a particular feature of the present invention that drive mechanism 14 is configured to move at least part of body-engaging element 12 through a repetitive cyclic motion which includes an operative motion along a first path operative to apply tension to the lower back of the subject, and a return motion along a second path, the second path lying generally below the first path.

The second path is described as "lying generally lower than" the first path. In other words, the path followed by at least part of body-engaging element 12 as viewed from the side circumscribes a non-zero area. This property preferably results from the preferred form of one or both of the first and second paths. Specifically, the operative motion along the first path preferably includes a primarily vertical lifting motion followed by a primarily horizontal tensioning motion. Furthermore, the return motion along the second path preferably includes a primarily vertical lowering motion followed by a primarily horizontal return motion.

Figure 1B:
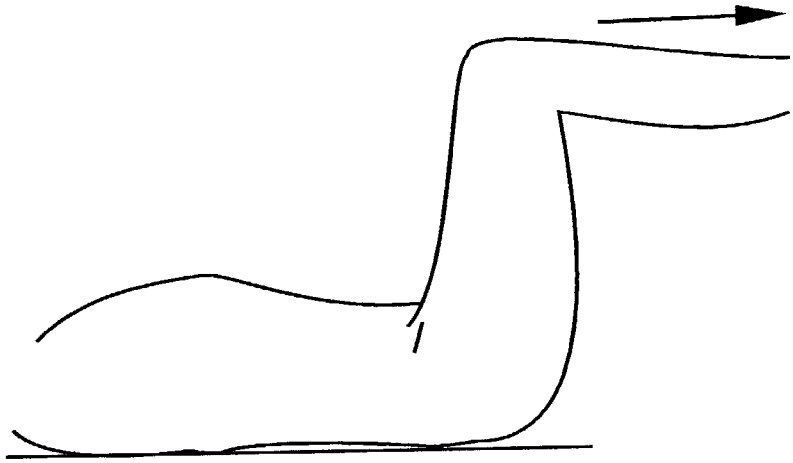
Figure 1C:
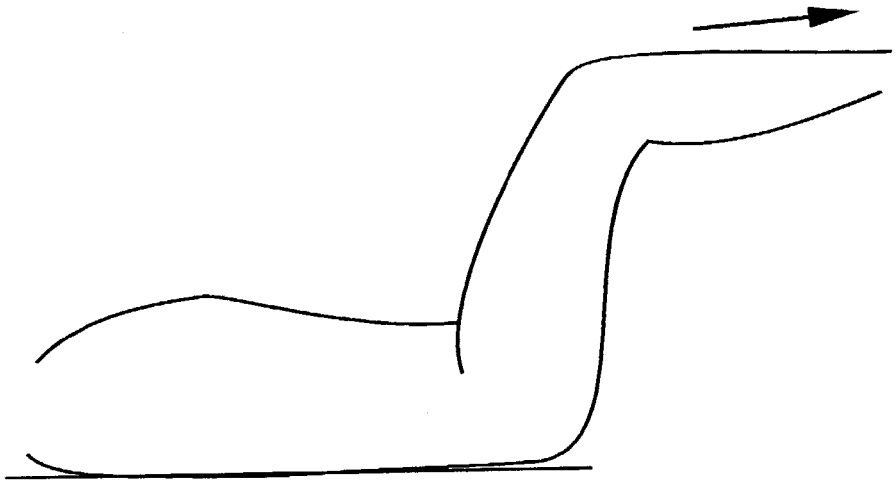
Figure 2:
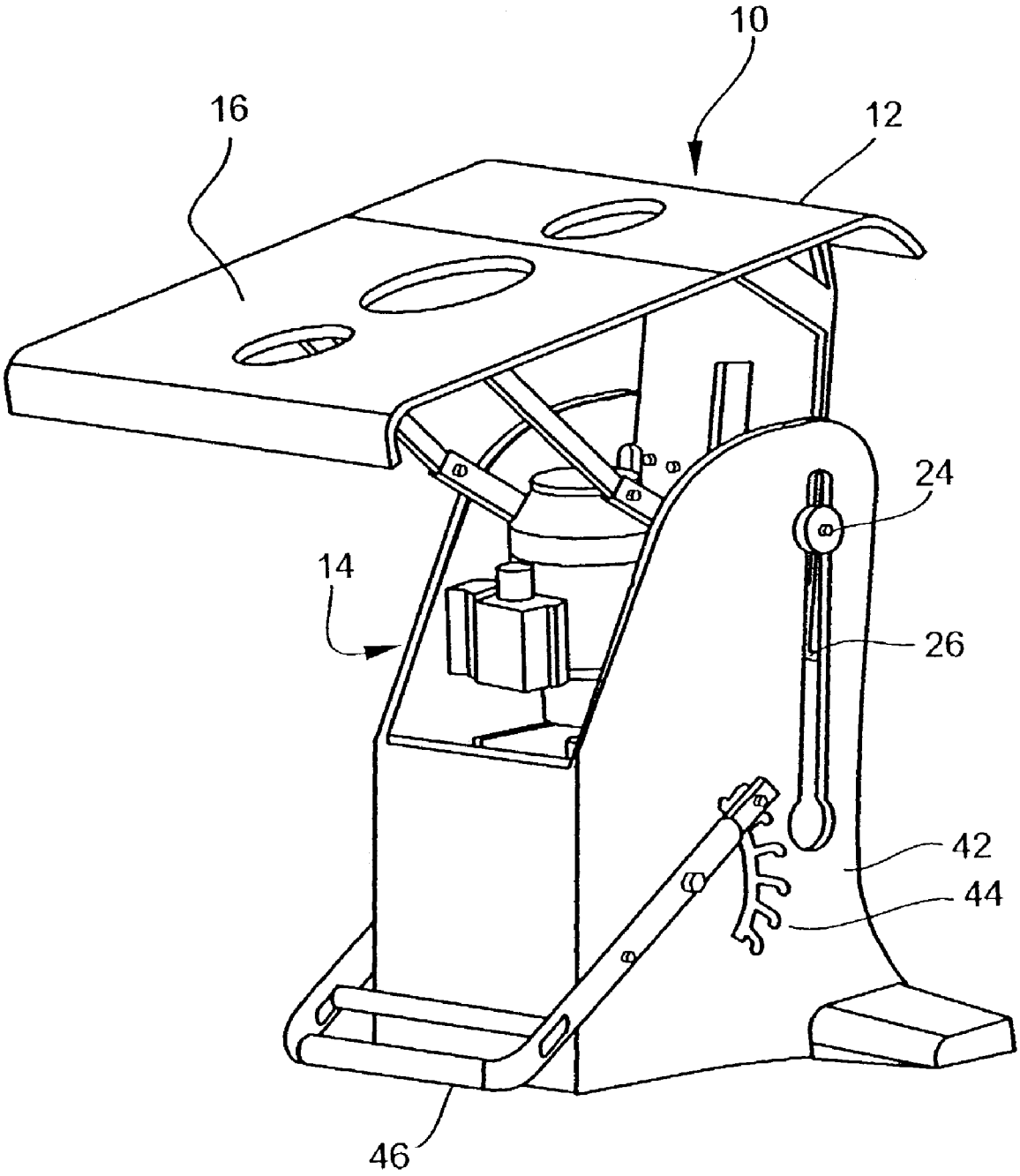
FIG. 2 is an isometric view of a first embodiment of a device, constructed and operative according to the teachings of the present invention, for preventing or relieving pain in the lower back of a human subject.
Figure 3:
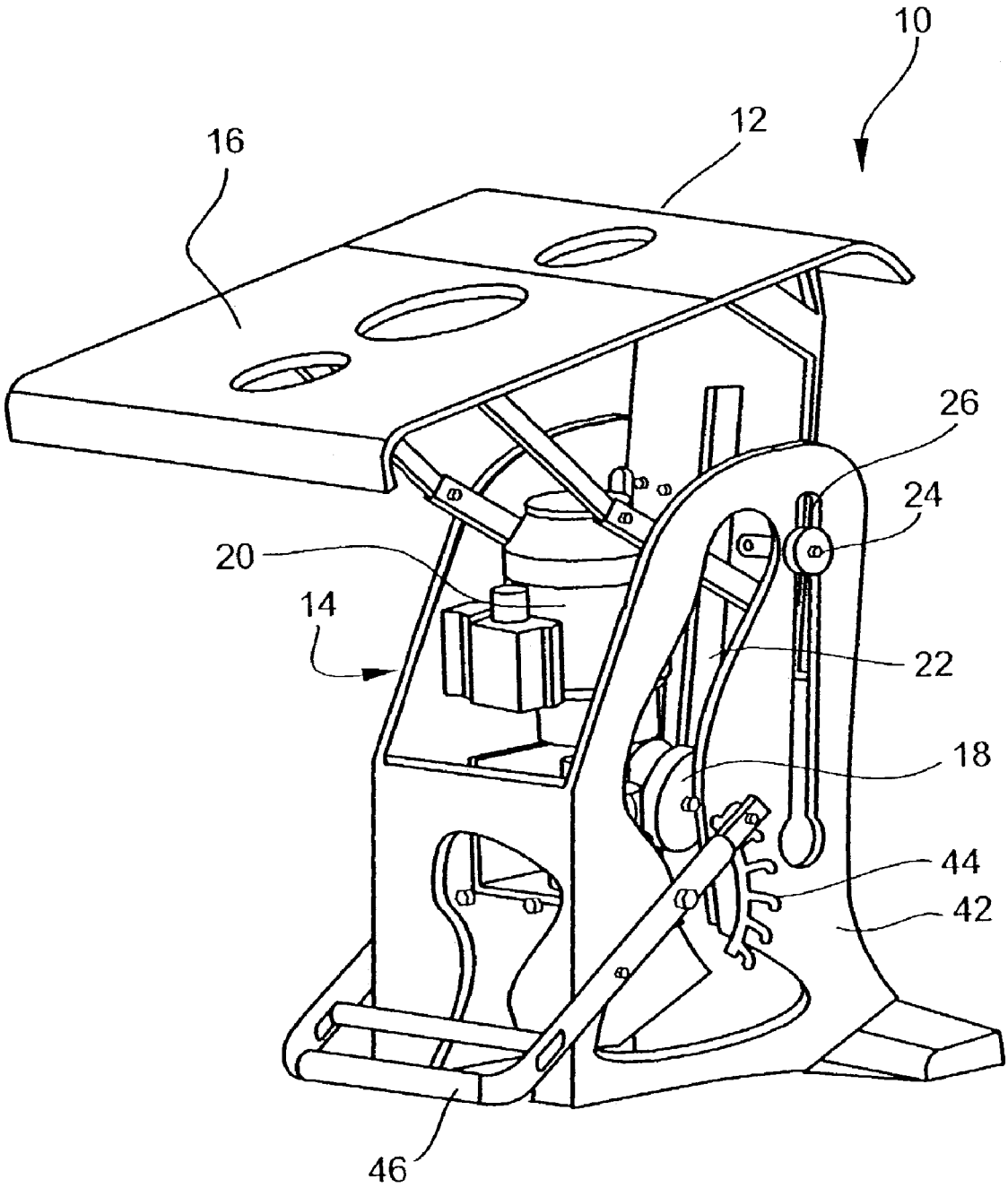
FIG. 3 is a partially cut-way view similar to FIG. 2 showing the main internal components of the device.
Figure 4:
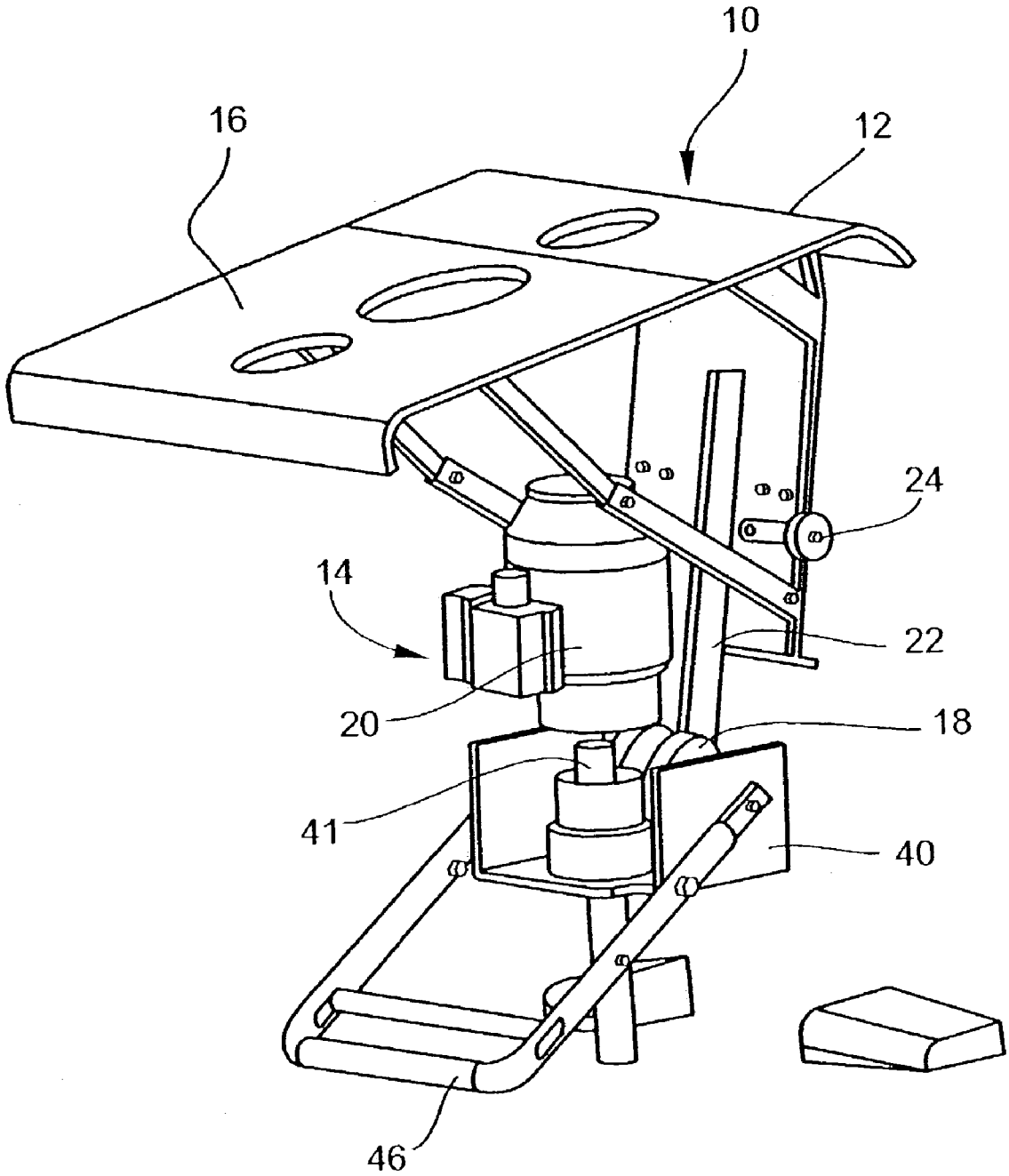
FIG. 4 is a view similar to FIG. 2 with the walls of the device removed.
Figure 5:
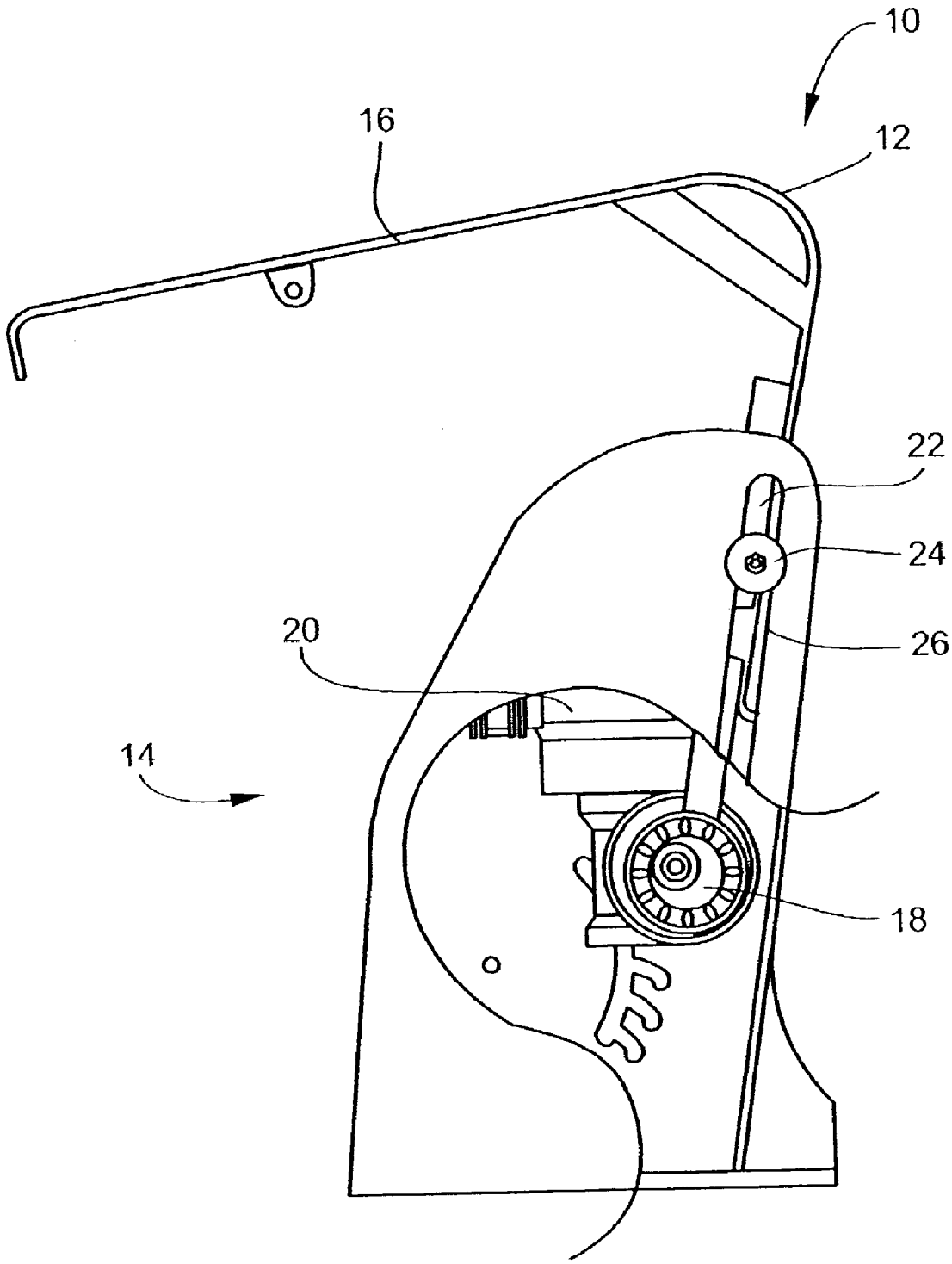
FIG. 5 is a partially cut-away side view of the device of FIG. 2.
Figure 6D:
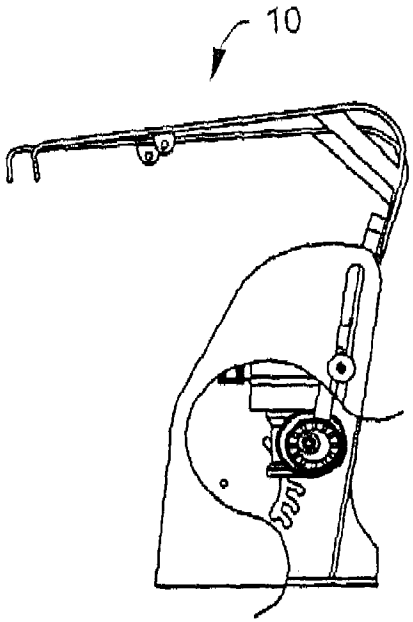
FIGS. 6*a*–6*d* are schematic views similar to FIG. 3 showing successive positions during operation of the device (somewhat exaggerated for clarity of presentation)
Figure 6C:
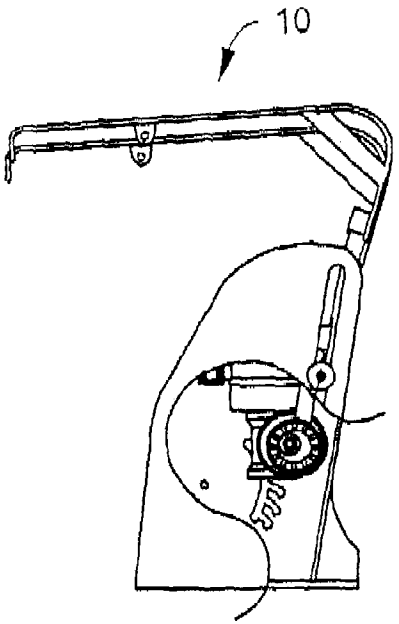
Figure 6B:
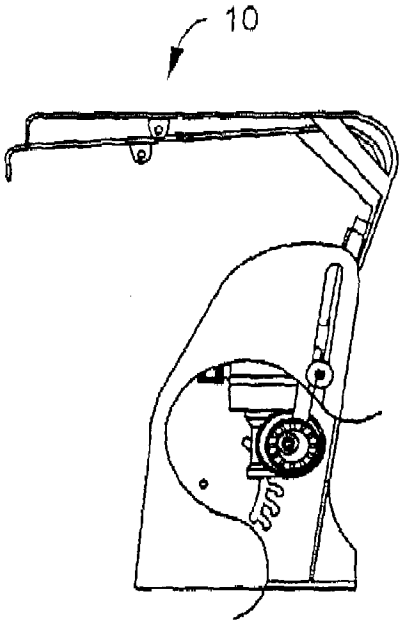
Figure 6A:
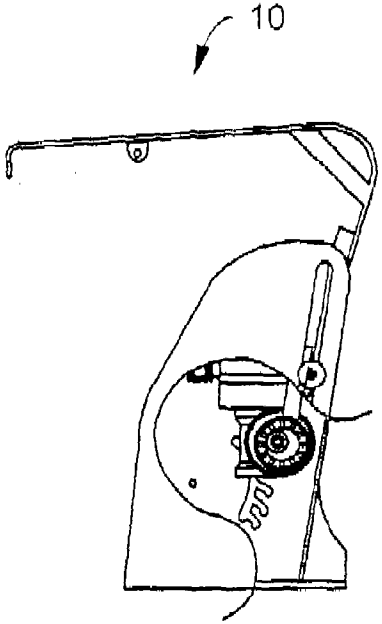

It will be immediately apparent that this cyclic motion provides a much better emulation of the aforementioned therapeutic movement used by trained physiotherapists than is offered by the prior art devices. Specifically, the preferred form of the operative motion along the first path closely parallels the sequence described above with reference to FIGS. 1A–1C. Furthermore, the preferred form of the return motion serves to first lower the body back into full contact with the underlying surface before releasing the horizontal tension, thereby tending to retain a proportion of the stretching effect at the end of each cycle. Without in any way limiting the scope of the present invention, it is thought that this residual stretching effect from each cycle gives rise to a cumulative stretching effect which may be responsible for the highly effective pain relief which has been experienced by users of the device during preliminary trials.

Turning now to the features of device 10 in more detail, it should be noted that body-engaging element 12 may engage any part of the body inferior to the subject's lumbar vertebrae in order to apply appropriate tension on the lumbar region of the subject's back. In the non-limiting preferred examples described herein, body-engaging element 12 includes at least one portion for engaging the rear surface of each of the user's knees. Optionally, although not necessarily, element 12 may also be provided with at least one surface 16 configured for supporting the rear side of the subject's legs below the knees for added comfort. In this case, the subject lies on the underlying surface in a supine position with his or her legs resting on surface 16. Preferably, surface 16 is angled downwardly-away from the user's body so that the user's knees effectively lock around the surface 16 to enable exertion of tension along the upper leg away from the body. A preferred angle of inclination relative to the underlying surface is between about 5° and about 70°. For compact storage, all or part of surface 16 may be hinged or otherwise foldable to a stowed position when not in use. If desired, additional mechanical body-engaging elements such as foot straps (not shown) or the like may be provided to engage the body to the device more securely. In most cases, however, such additional elements have not been found necessary.

As mentioned before, the repetitive cyclic motion generated by drive mechanism 14 includes an operative motion along a first path and a return motion along a second path, the second path lying generally below the first path. In other words, the motion of at least one, and typically all, points on surface 16 undergo cyclic motion along a closed path which encloses a non-zero area. Preferably, in order to avoid percussive motion, the first and second paths are chosen to together form a closed curve lying substantially in a vertical plane. Most preferably, the closed path approximates to the form of an ellipse. Optionally, although not necessarily, at least one point on surface 16 may follow a substantially circular path (a circle being a special case of an ellipse).

The dimensions of the path followed depend of the type of treatment required and the state of health of the subject. In most cases, the maximum dimension of the closed curve is less than about 10 cm, and in most preferred cases, falls within the range from about 2 cm to about 6 cm. Optionally, a user-operable adjustment may be provided to allow selection of the magnitude of the motion as desired.

In structural terms, FIGS. 3–6 illustrate one particularly simple implementation of drive mechanism 14 for producing elliptical motion. Specifically, drive mechanism 14 as shown includes at least one rotating element, typically a drive wheel 18 driven by an electric motor 20 with a suitable step down gear arrangement. By way of a non-limiting example, a typical implementation employs an 80 W AC motor operating at about 1400 rpm with step-down gears etc. bringing the final motion down to a frequency of roughly 30 rpm. Suitable motors with external and/or built-in gear arrangements are commercially widely available. The repetitive cyclic motion of body-engaging element 12 is then generated, at least in part, by a mechanical linkage 22 which links element 12 to an off-axis point on the rotating element. In the implementation shown, a second part of linkage 22 is mounted via one or more sliding pivots 24 within slots 26.

Figure 7:
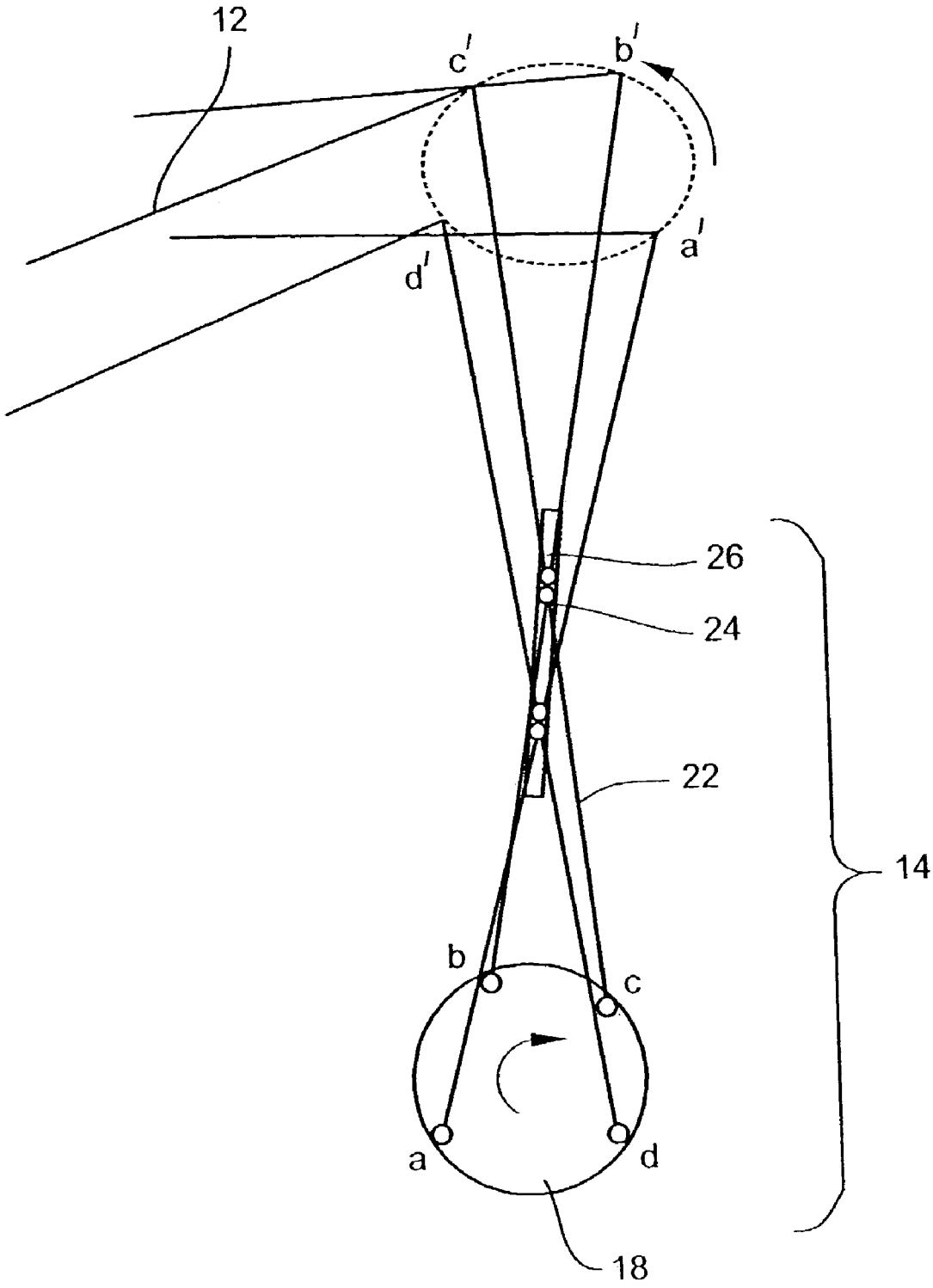
FIG. 7 is a schematic representation of the drive mechanism of the device of FIG. 2 showing the form of motion produced thereby.
Figure 8B:
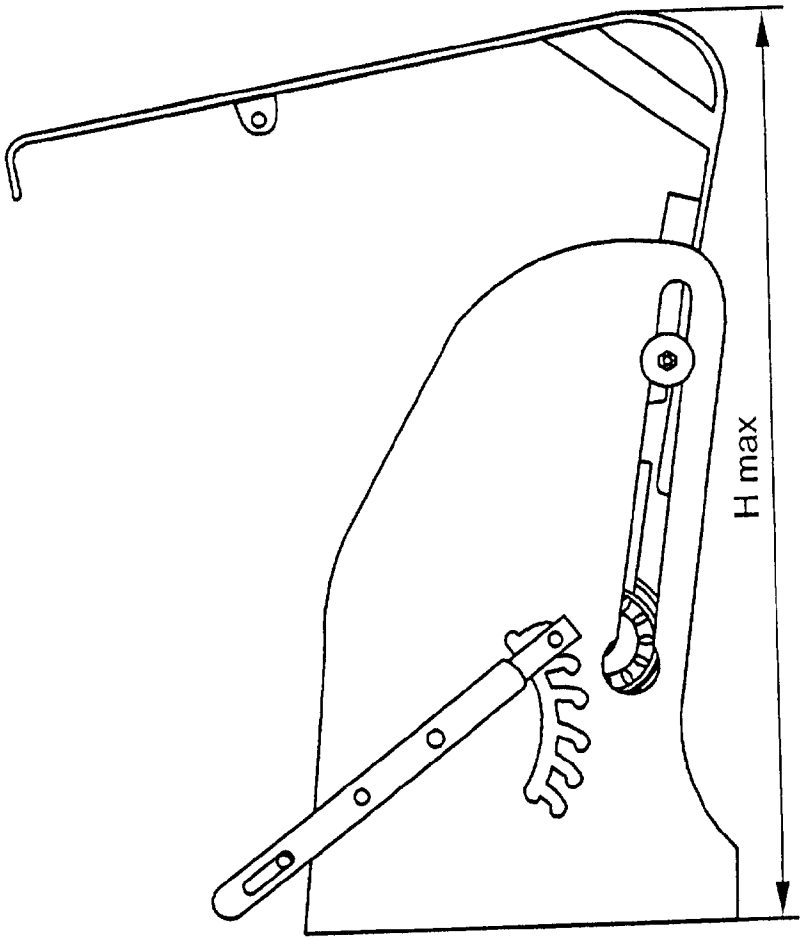
FIGS. 8*a* and 8*b* are side views of the device of FIG. 2 showing a preferred range of adjustment.
Figure 8A:
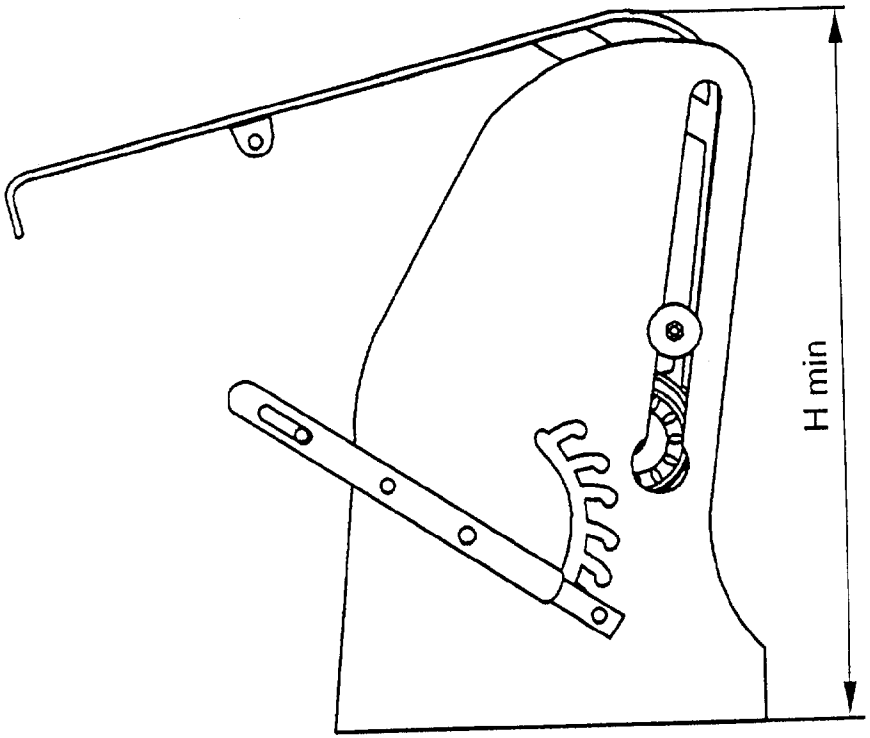

The motion resulting from this structure is illustrated schematically in FIG. 7. As the point of attachment of linkage 22 moves with turning of drive wheel 18 through positions a, b, c and d, the uppermost portion of surface 16 follows an elliptical path through positions a', b', c' and d', respectively. This corresponds to the required primarily vertical lifting motion (a' to b') and primarily horizontal tensioning motion (b' to c'), together making up the first path, and the return motion (c' via d' back to a') along a lower second path. A similar motion is represented by the sequence of FIGS. 6A–6D, the initial position being shown for reference in each Figure by a dashed outline.

It will be noted that the smoothly curved form of the motion provides gradual transitions between the various "primarily vertical" and "primarily horizontal" movements. As a result, the specific points identified by the symbols a', b', c' and d' are not necessarily uniquely and unambiguously defined. Nevertheless, it is clear that an elliptical motion in a vertical plane inherently includes portions in which the vertical component of the motion is significantly greater than the horizontal component and vice versa, paths including such portions being referred to as "primarily vertical" and "primarily horizontal" movements, respectively.

In order to facilitate use of device 10 for subjects of different sizes, an adjustment mechanism is preferably provided for varying the height of body-engaging element 12 above the underlying surface. This adjustment mechanism may be implemented in a range of ways, including, but not limited to, varying the length of linkage 22, either above or below sliding pivots 24, or by raising or lowering the entirety of drive mechanism 14.

In the embodiment of FIGS. 2–8B, adjustment is achieved by mounting the entirety of drive mechanism 14 in a cradle 40 (see FIG. 4) which can be raised and lowered along a vertical alignment rod 41 relative to a housing of the device. Specifically, as seen in FIGS. 2, 3, 8A and 8B, side walls 42 of the housing feature a set of adjustment slots 44 within which a lever arm 46 may be locked. Lever arm 46 is pivotally linked to cradle 40 to that adjustment of lever arm 46 raises or lowers adjustment mechanism 14, and hence body-engaging element 12 between the lowered position of FIG. 8A and the raised position of FIG. 8B. Slots 26 are made sufficiently long to accommodate both the range of adjustment and the range of motion during operation in each of the extreme positions. The range of adjustment may extend from about 30 cm up to about 65 cm as measured to the highest part of surface 16 above the underlying surface. In practice, a range from about 40 cm to about 55 cm is sufficient to accommodate most adult users.

It should be noted that this is just one exemplary implementation of an adjustment mechanism. Clearly, many alternative implementations of such mechanisms are within the ability of one ordinarily skilled in the art. One further example will be illustrated below with reference to FIGS. 9 and 10.

Figure 9:
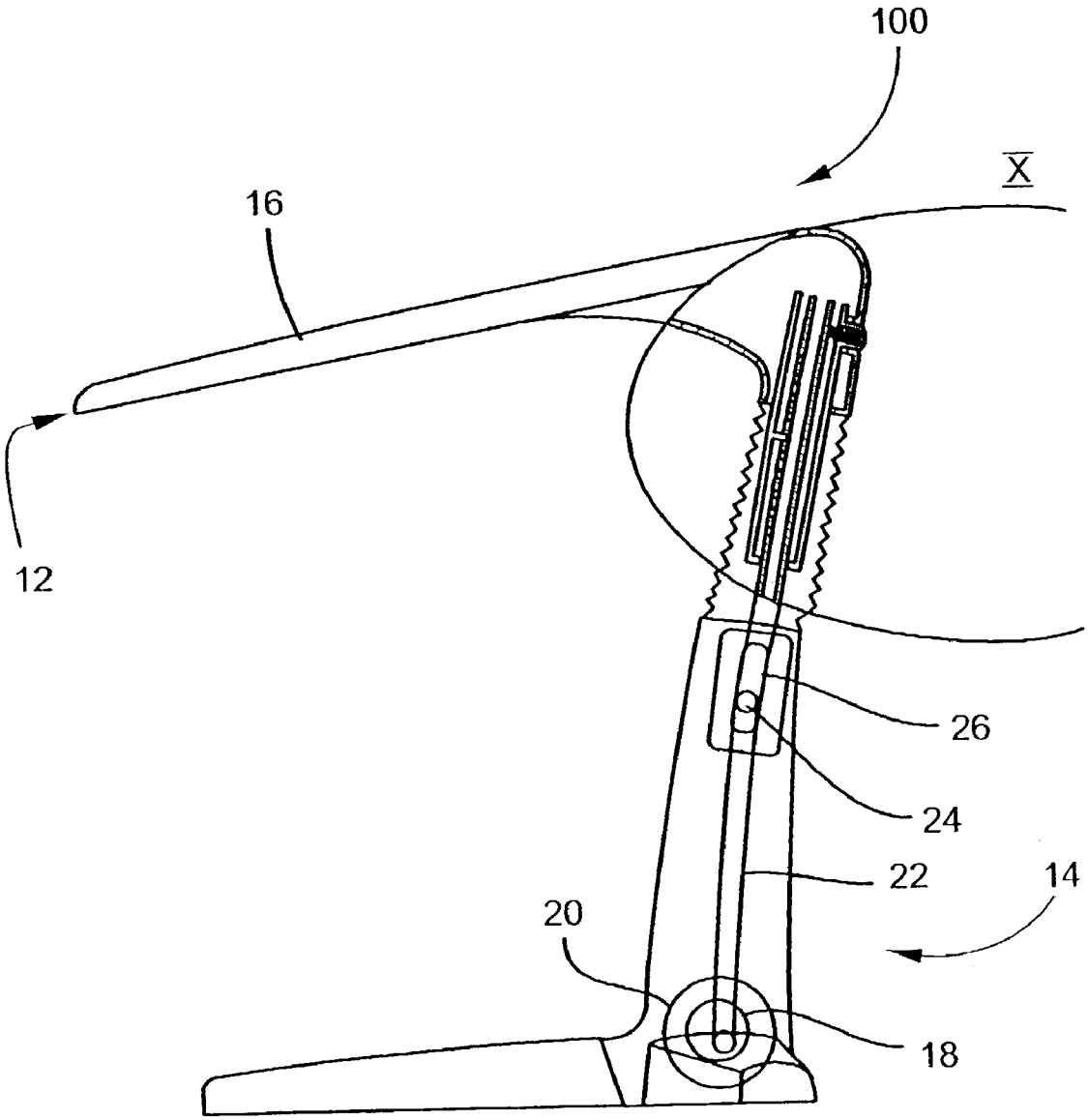
FIG. 9 is a partially cut-away side view of a second embodiment of a device, constructed and operative according to the teachings of the present invention, for preventing or relieving pain in the lower back of a human subject.
Figure 10:
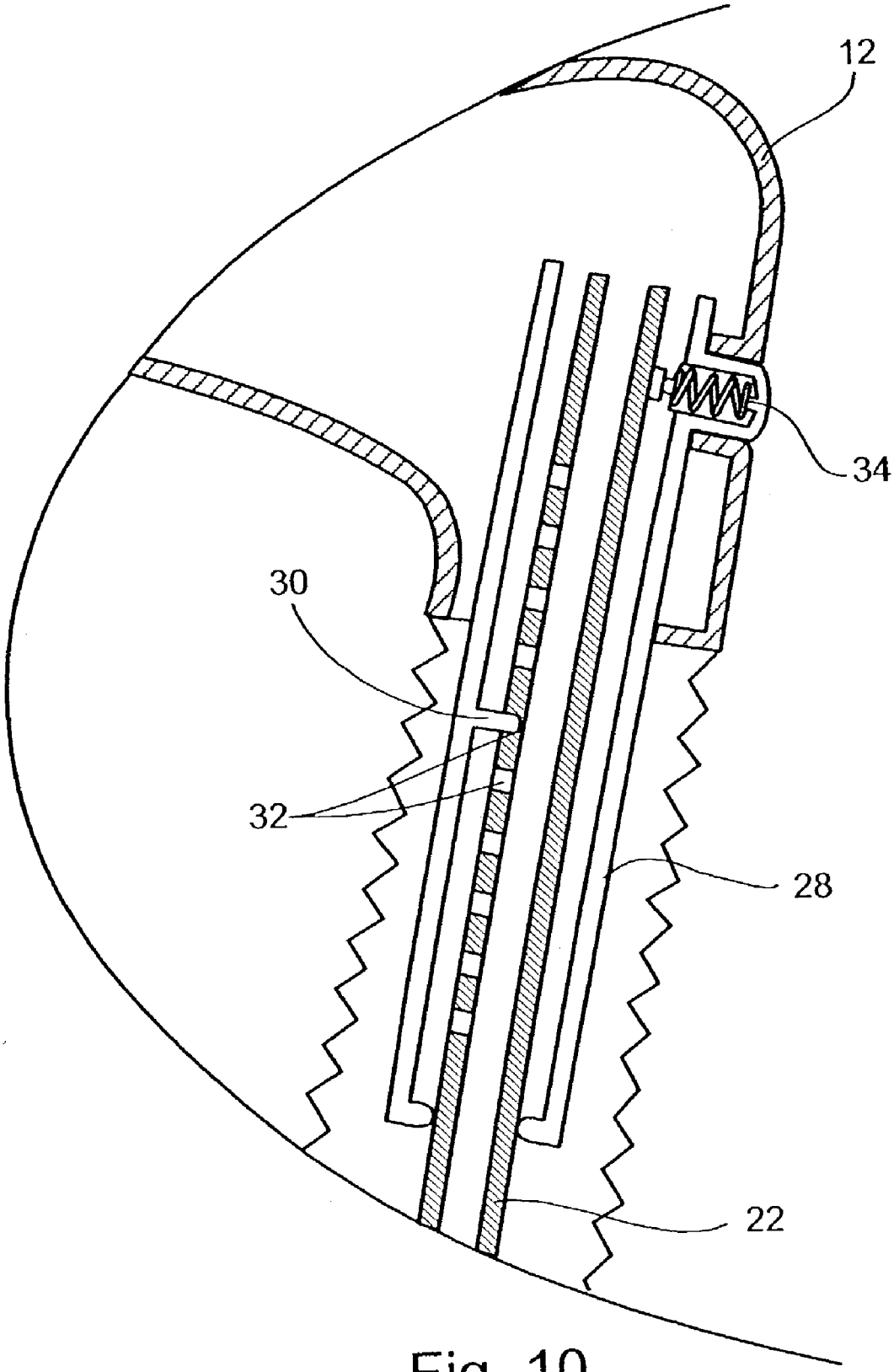
FIG. 10 is an enlargement of the region of FIG. 9 designated X.

Turning now to FIGS. 9 and 10, there is shown a second embodiment of a device, generally designated 100, constructed and operative according to the teachings of the present invention. Device 100 is generally similar to device 10, equivalent elements being designated similarly. Device 100 differs primarily in the implementation of the adjustment mechanism used.

Specifically, FIG. 10 illustrates schematically a further possible implementation of an adjustment mechanism in which the length of linkage 22 is adjustable above pivots 24. This is achieved by use of a lockable telescopic connection in which the main support element of linkage 22 is slidably engaged within a sleeve 28 attached to body-engaging element 12. Sleeve 28 features a pin 30 which engages one of a row of recesses 32 in the support element. A spring element 34 urges the support element into against pin 30 tending to maintain engagement between pin 30 and one of recesses 32. To adjust the height, the elements are twisted so as to compress spring element 34 and free pin 30 from engagement with its initial recess 32. Body-engaging element 12 can then be raised or lowered telescopically relative to the support element and pin 30 brought into engagement with an appropriate recess 32 to maintain the desired height.

Figure 11:
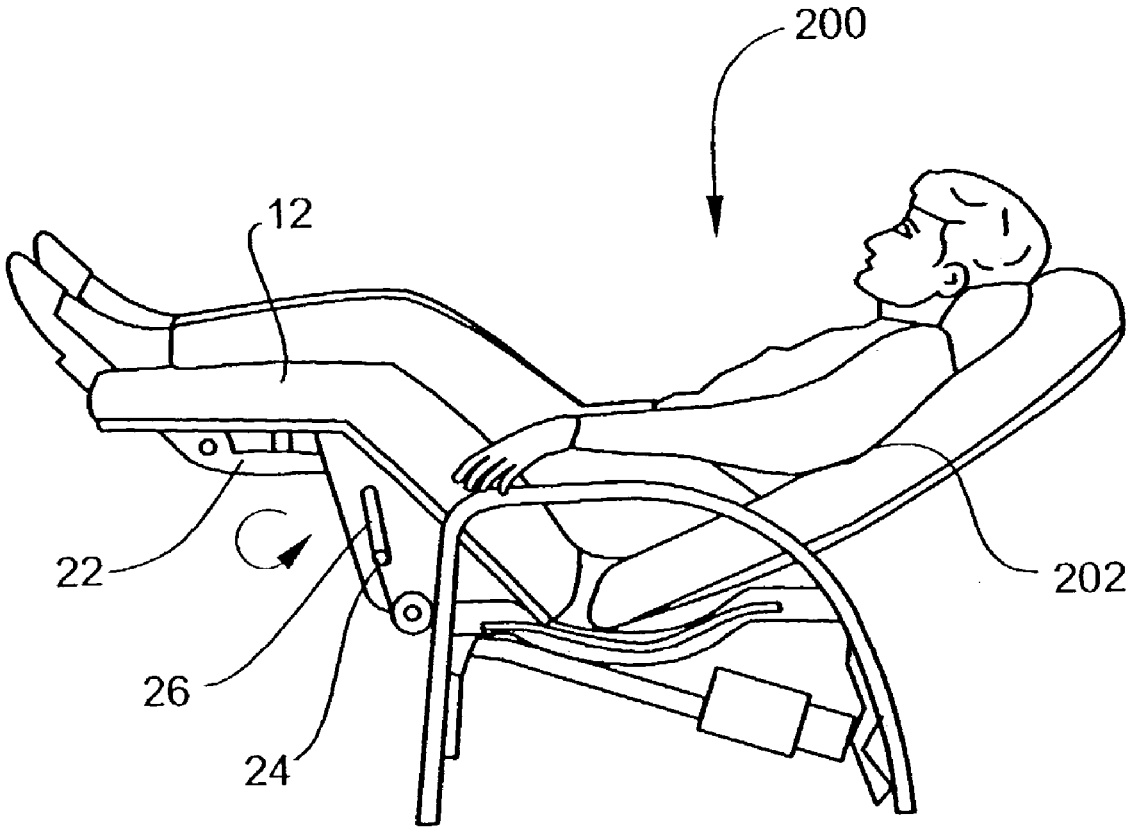
FIG. 11 is a schematic side view of a third embodiment of a device, constructed and operative according to the teachings of the present invention, for preventing or relieving pain in the lower back of a human subject, the device being implemented as part of a chair.

Finally, with reference to FIG. 11, it should be appreciated that the device of the present invention may be integrated with various other devices and structures. By way of one particular preferred example, FIG. 11 shows an implementation of the device of the present invention, generally designated 200, in which body-engaging element 12 is implemented as at least one body-supporting surface of a chair. The "underlying surface" which supports the back of the user is, in this case, the back rest 202 of the chair. Parenthetically, as will be noted from this example, the "underlying surface" of the present invention is not necessarily horizontal. In other respects, device 200 is similar in structure and operation to device 10 described above, equivalent elements being labeled similarly.

It will be appreciated that the above descriptions are intended only to serve as examples, and that many other embodiments are possible within the spirit and the scope of the present invention.

What is claimed is:

1. A device for preventing or relieving pain in the lower back of a human subject while the subject lies in a supine position on an underlying surface, the device comprising:

(a) a body-engaging element configured for engaging the two legs of the subject inferior to the subject's lumbar vertebrae while the subject lies in a supine position on the underlying surface; and (b) a drive mechanism mechanically linked to said body-engaging element, said drive mechanism being configured to move said body-engaging element through a repetitive cyclic motion including:

(a) an operative motion along a first path in a direction parallel to the subject's legs operative to move both legs of the subject engaged by said body-engaging element together through said first path parallel to the subject's legs to apply tension to the lower back of the subject, and (b) a return motion along a second path, said second path being different from, and lying generally below, said first path.

2. The device of claim 1, wherein said body-engaging element includes a surface configured for engaging a rear surface of both knees of the subject.

3. The device of claim 1, wherein said first path includes a primarily vertical lifting motion followed by a primarily horizontal tensioning motion.

4. The device of claim 1, wherein said second path includes a primarily vertical lowering motion followed by a primarily horizontal return motion.

5. The device of claim 1, wherein said first and second paths together form a closed curve lying substantially in a vertical plane.

6. The device of claim 5, wherein a maximum dimension of said closed curve is no greater than about 10 cm.

7. The device of claim 1, wherein said first and second paths together approximate the form of an ellipse.

8. The device of claim 7, wherein a maximum dimension of said ellipse is no greater than about 10 cm.

9. The device of claim 7, wherein said ellipse is a circle.

10. The device of claim 1, wherein said drive mechanism includes at least one rotating element, said repetitive cyclic motion being generated at least in part by a link coupled to said rotating element and eccentric to the rotary axis of said rotating element.

11. The device of claim 1, further comprising a housing configured for supporting said drive mechanism above the underlying surface, wherein said drive mechanism is adjustably mounted relative to said housing to allow adjustment of a height of said drive mechanism, and hence also of said body-engaging element, above the underlying surface.

12. The device of claim 1, wherein said body-engaging element is linked to said drive mechanism via an adjustable linkage configured to allow adjustment of a height of said body-engaging element relative to said drive mechanism.

13. The device of claim 1, wherein said body-engaging element is a body-supporting surface of a chair.

14. A device for preventing or relieving pain in the lower back of a human subject, the device being configured for use while the subject lies in a supine position on an underlying surface, the device comprising:

(a) a body-engaging element configured for engaging a body part of the subject inferior to the subject's hip joint joining the thigh to the hip while the subject lies in a supine position on the underlying surface; and (b) a rotary drive for driving the body engaging element, said rotary drive including a pivot pin pivotally mounting the body engaging element and slidable within a slot during the rotation of said rotary drive such as to drive the body-engaging element, and the body part when engaged thereby, from an initial position through repetitive closed-loop cycles each including:

(i) a forward stroke path having a vertical lifting component for lifting the engaged body part such as to neutralize the natural arched concavity of the subject's back, and a horizontal pulling component in a direction parallel to the axis of the subject's lumber vertebrae for tensioning the engaged body part, and the subject's thigh to relieve pressure in the subject's lumber vertebrae; and (ii) a return stroke path, different from and underlying the forward stroke path, for returning the engaged body part to its initial position.

15. The device according to claim 14, wherein said drive includes:

a rotary element rotatable about a rotary axis; and a link coupled at one end to said rotary element eccentrically with respect to its rotary axis, and coupled at its opposite end to said body engaging element; said pivot pin being carried by said link between its opposite ends and slideable in said slot by the rotation of said one end of the link by said rotary element to cause said opposite end of the link, and said body-engaging element coupled thereto, to be driven through said closed-loop cycles.

16. A device for preventing or relieving pain in the lower back of a human subject while the subject lies in a supine position on an underlying surface, the device comprising:

(a) a body-engaging element configured for engaging the rear surfaces of both knees of the subject; and (b) a drive mechanism mechanically linked to said body-engaging element, said drive mechanism being configured to move said body-engaging element through a repetitive cyclic motion including:

(i) an operative motion along a first path operative to move both upper legs together in the outward direction substantially parallel to their longitudinal axes to apply tension to the lumbar vertebrae in the lower back of the subject, and (ii) a return motion along a second path, said second path lying generally below said first path.

17. The device of claim 16, wherein said first path includes a primarily vertical lifting motion followed by a primarily horizontal tensioning motion.

18. The device of claim 16, wherein said second path includes a primarily vertical lowering motion followed by a primarily horizontal return motion.

19. The device of claim 16, wherein said first and second paths together approximate an ellipse.

20. The device of claim 16, wherein said drive mechanism includes at least one rotating element, said repetitive cyclic motion being generated at least in part by a link eccentrically coupled to said rotating element.

21. The device of claim 16, wherein said body-engaging element is linked to said drive mechanism via an adjustable linkage configured to allow adjustment of the height of said body-engaging element relative to said drive mechanism.

22. A device for preventing or relieving pain in the lower back of a human subject, the device being configured for use while the subject lies in a supine position on an underlying surface, the device comprising:

(a) a body-engaging element configured for engaging the rear surfaces of both knees of the subject; and (b) a rotary drive for driving said body engaging element, said rotary drive including a pivot pin pivotally mounting the body engaging element and slidable within a slot during the rotation of said rotary drive such as to drive the body-engaging element, and both knees when engaged thereby, from an initial position through repetitive closed-loop cycles each including:

(i) a forward stroke path having a vertical lifting component for lifting the engaged rear surfaces of both knees together such as to neutralize the natural arched concavity of the subject's back, and a horizontal pulling component in a direction parallel to the subject's lees for tensioning the engaged rear surfaces of both knees such as to relieve pressure in the subject's lumber vertebrae; and (ii) a return stroke path, different from and underlying the forward stroke path, for returning the engaged rear surfaces of both knees to their initial positions.

23. The device of claim 22, wherein said drive includes: a rotary element rotatable about a rotary axis; and a link coupled at one end to said rotary element eccentrically with respect to its rotary axis, and coupled at its opposite end to said body engaging element; said pivot pin being carried by said link between its opposite ends and slidable in said slot by the rotation of said one end of the link by said rotary element to cause said opposite end of the link, and said body-engaging element coupled thereto, to be driven through said closed-loop cycles.

24. The device of claim 22, wherein said body-engaging element includes a supporting panel configured to support both lower legs of the subject, said panel being inclined downwardly towards the end thereof to face the subject's feet.

25. The device of claim 24, wherein said supporting panel is vertically adjustable with respect to said underlying surface to accommodate subjects of different sizes.

26. The device of claim 22, wherein said repetitive closed-looped cycles are of elliptical configuration.

* * * * *